US009548032B2

(12) United States Patent
Sun

(10) Patent No.: US 9,548,032 B2
(45) Date of Patent: Jan. 17, 2017

(54) APPARATUS FOR REDUCING POWER CONSUMPTION OF LIQUID CRYSTAL PANEL AND METHOD FOR THE SAME

(71) Applicant: BEIJING BOE OPTOELECTRONICS TECHNOLOGY CO., LTD., Beijing (CN)

(72) Inventor: Wei Sun, Beijing (CN)

(73) Assignee: BEIJING BOE OPTOELECTRONICS TECHNOLOGY CO., LTD., Beijing (CN)

( * ) Notice: Subject to any disclaimer, the term of this patent is extended or adjusted under 35 U.S.C. 154(b) by 80 days.

(21) Appl. No.: 14/085,173

(22) Filed: Nov. 20, 2013

(65) Prior Publication Data

US 2014/0139417 A1 May 22, 2014

(30) Foreign Application Priority Data

Nov. 20, 2012 (CN) ..... 2012 1 0472969

(51) Int. Cl.
*G09G 3/36* (2006.01)

(52) U.S. Cl.
CPC ..... *G09G 3/3648* (2013.01); *G09G 3/3666* (2013.01); *G09G 3/3677* (2013.01); *G09G 2300/0413* (2013.01); *G09G 2330/021* (2013.01)

(58) Field of Classification Search
CPC ..... G09G 3/3666; G09G 3/3677; G09G 2330/021; G09G 3/2085; G09G 2310/0221; G09G 3/3644; G09G 3/3648; G09G 2300/0413

(Continued)

(56) References Cited

U.S. PATENT DOCUMENTS 5,907,314 A * 5/1999 Negishi et al. ..... 345/103
6,219,022 B1 * 4/2001 Yamazaki et al. ..... 345/103

(Continued)

FOREIGN PATENT DOCUMENTS

JP 2003-344823 A 12/2003
JP 2011-203687 A 10/2011
WO 2012017640 A1 2/2012

OTHER PUBLICATIONS

Translation of JP, 2011-203687.*

(Continued)

*Primary Examiner* — Dmitriy Bolotin
(74) *Attorney, Agent, or Firm* — Ladas & Parry LLP

(57) ABSTRACT

An apparatus for reducing power consumption of a liquid crystal panel is provided. The apparatus comprises Thin Film Transistors formed on each of data lines, cut line formed in the direction parallel to gate lines and connected to the gate of the TFTs, and a switching control unit; wherein, the switching control unit controls the on/off state of the TFTs via the cut line during transmission of a data signal so as to control the number of the capacitors to be charged on the data line of the liquid crystal panel. A method for reducing power consumption of a liquid crystal panel is provided at the same time. By adopting the apparatus and the method provided in the embodiments of the present invention, the power consumption of the liquid crystal panel can be reduced effectively during the operation of the liquid crystal panel.

8 Claims, 2 Drawing Sheets

(58) Field of Classification Search
USPC ..... 345/87–104
See application file for complete search history.

(56) References Cited

U.S. PATENT DOCUMENTS

| | | | | |
|---|---|---|---|---|
| 6,229,516 | B1 * | 5/2001 | Kim et al. | 345/103 |
| 6,590,553 | B1 * | 7/2003 | Kimura et al. | 345/92 |
| 6,624,801 | B2 * | 9/2003 | Moriyama | 345/100 |
| 6,624,865 | B2 * | 9/2003 | Edwards | 349/139 |
| 7,023,419 | B2 * | 4/2006 | Park | 345/103 |
| 7,369,187 | B2 * | 5/2008 | Park | 349/38 |
| 7,755,711 | B2 * | 7/2010 | Kenmochi et al. | 349/48 |
| 2001/0052888 | A1 * | 12/2001 | Hebiguchi | 345/87 |
| 2002/0047820 | A1 * | 4/2002 | Ha | 345/87 |
| 2002/0084965 | A1 * | 7/2002 | Park | 345/87 |
| 2002/0109649 | A1 * | 8/2002 | Edwards | 345/55 |
| 2005/0156840 | A1 * | 7/2005 | Kim et al. | 345/87 |
| 2008/0165109 | A1 * | 7/2008 | Joo et al. | 345/98 |

OTHER PUBLICATIONS

First Chinese Office Action dated Jun. 3, 2015; Appln. No. 201210472969.X.
Second Chinese Office Action dated Nov. 23, 2015; Appln. No. 201210472969.X.
Third Chinese Office Action dated May 24, 2016; Appln. No. 201210472969.X.

* cited by examiner

APPARATUS FOR REDUCING POWER CONSUMPTION OF LIQUID CRYSTAL PANEL AND METHOD FOR THE SAME

TECHNICAL FIELD

The disclosure relates to the field of a liquid crystal displaying technique, particularly to an apparatus for reducing power consumption of a liquid crystal panel and a method for the same.

BACKGROUND

With the development of science and technology, a mobile electronic product has found increasing applications. Meanwhile, requirements for the service time of the mobile electronics product become higher and higher. Thus, a variety of large manufacturers currently focus on the issues of reducing power consumption of the mobile electronics product, increasing the service time of the mobile device, and occupying the market of a panel of small size.

At present, during the procedure of improving the performance of the mobile electronic product, the mobile electronic product such as a pad achieves a higher resolution, so that the power consumption of the mobile device in use increases accordingly. Thus, during the use of the mobile device, in the case that the display quality of a panel is ensured, the power consumption of the panel increases continuously, thereby the endurance of the mobile device deteriorating. Herein, the endurance refers to the time when the mobile device can operate continuously under the condition that the available battery carried in the mobile device is exhausted without being recharged midway.

It can be seen from the above that how to reduce the power consumption of the panel of the mobile device under the condition of the high resolution is an urgent problem to be solved at present.

SUMMARY

In view of the above, embodiments of the present invention provide an apparatus for reducing power consumption of a liquid crystal panel and a method for the same, to enable to reduce effectively the power consumption of the liquid crystal panel during the operation of the liquid crystal panel.

In order to solve the technical problems existing in the prior art, technical solutions of the present invention may be implemented as follows.

In one aspect of the invention, there provides an apparatus for reducing the power consumption of the liquid crystal panel. The apparatus comprises Thin Film Transistors respectively formed on each of data lines, cut line formed in the direction parallel to gate lines and connected to the gate of the TFTs, and a switching control unit; wherein, the switching control unit is used to control the on/off state of the TFTs via the cut line during transmission of a data signal so as to control the number of the capacitors to be charged on the data lines of the liquid crystal panel.

Further, the number of the TFTs on each of data lines is more than one, and accordingly the number of the cut line is more than one.

Further, the switching control unit is adapted to control all the TFTs to be turned on via the cut line when being informed that the data lines start to transmit a data signal, so that all the capacitors on the data lines are charged; and during the transmission of the data signal, control via the cut line located under the gate lines which complete the transmission of the data signal the TFTs connected to the cut line located under the gate lines which complete the transmission of the data signal to be turned off when being informed that the transmission of the data signal corresponding to the gate lines located above each of the cut line is completed, so that the capacitors on the data lines which are located under the turned-off TFTs are charged to continue the transmission of the data signal.

Further, the apparatus comprises a timer/counter controlling register for informing the switching control unit that the data lines start to transmit the data signal, and during the transmission of the data signal, informing the switching control unit that the transmission of the data signal corresponding to the gate lines located above each of the cut line is completed.

Further, the switching control unit is further adapted to control all the TFTs to be turned on via the cut line when being informed by the timer/counter controlling register that the data lines start to transmit the data signal; and control the TFTs connected to the cut line located under the gate lines which complete the transmission of the data signal to be turned off, via the cut line located under the gate lines which complete the transmission of the data signal, when being informed by the timer/counter controlling register that the transmission of the data signal corresponding to the gate lines located above each of the cut line is completed.

In another embodiment of the present invention, a method for reducing the power consumption of the liquid crystal panel is provided. The method comprises: forming Thin Film Transistors on each of data lines, and forming cut line connected to the gate of the TFTs in the direction parallel to gate lines; controlling the on/off state of the TFTs via the cut line during the transmission of the data signal so as to control the number of the capacitors to be charged on the data lines of the liquid crystal panel.

Further, the step of controlling the on/off state of the TFTs via the cut line during the transmission of the data signal so as to control the number of the capacitors to be charged on the data line of the liquid crystal panel comprises: controlling all the TFTs to be turned on via the cut line by a switching control unit when being informed that the data lines start to transmit the data signal, so that all the capacitors on the data line are charged; and during the transmission of the data signal, controlling the TFTs connected to the cut line located under the gate lines which complete the transmission of the data signal to be turned off, via the cut line located under the gate lines which complete the transmission of the data signal, by the switching control unit when being informed that the transmission of the data signal corresponding to the gate lines located above each of the cut line is completed, so that the capacitors on the data lines which are located under the turned-off TFTs are charged to continue the transmission of the data signal.

Further, in the method, the switching control unit is informed by a timer/counter controlling register that the data lines start to transmit the data signal and that the transmission of the data signal corresponding to the gate lines located above each of the cut line is completed.

Further, in the method, the timer/counter controlling register informs the switching control unit via a timing control signal that the data lines start to transmit the data signal; and that the transmission of the data signal corresponding to the gate lines located above each of the cut line is completed.

Further, in the method, the step of controlling all the TFTs to be turned on by the switching control unit via the cut line is embodied by outputting a high level signal to the gate of all the TFTs via the cut line; accordingly, the step of controlling the TFTs connected to the cut line located under the gate lines which complete the transmission of the data signal to be turned off via the cut line located under the gate lines which complete the transmission of the data signal is embodied by outputting a low level signal to the gate of the TFTs connected to the cut line located below the gate lines which complete the transmission of the data signal, via the cut line located under the gate lines which complete the transmission of the data signal.

In the apparatus for reducing the power consumption of the liquid crystal panel and the method for the same provided in the embodiments of the present invention, the Thin Film Transistors are formed on each of data lines, and cut line connected to the gate of the TFTs are formed in the direction parallel to the gate lines by means of a patterning process; a switching control unit controls the on/off state of the TFTs via the cut line during the transmission of the data signal so as to control the number of the capacitors to be charged on the data lines of the liquid crystal panel. Thus, the power consumption occurring on the data lines of the liquid crystal panel can be reduced effectively in the use of the liquid crystal panel, and the power consumption of the liquid crystal panel can be reduced effectively as well.

BRIEF DESCRIPTION OF THE DRAWINGS

In the following description in connection with the accompanying drawings, the features and advantages of the invention will become more apparent. In the drawings, the same element is represented with the same reference numeral.

DETAILED DESCRIPTION OF THE PREFERRED EMBODIMENTS

Hereinafter, the principles of the present invention are illustrated in detail with reference to the accompanying drawings and the particular embodiments of the invention.

Equation (1) shows a method for computing the logic power consumption relating to the liquid crystal panel:

$$\text{Power}=\sim n*C_{data}*V_{swing}*f/2 \quad (1)$$

wherein n represents the number of data lines on the liquid crystal panel, $C_{data}$ represents capacitors on the data lines, $V_{swing}$ represents an applied bias voltage, and f represents the frequency of the bias voltage; the value of n increases with the increase of the resolution of the liquid crystal panel, and at the same time the value of $C_{data}$ also increases with the increase of the resolution of the liquid crystal panel. Therefore, it can be seen from the equation (1) that the higher the resolution of the liquid crystal panel is, the more the power consumption of the liquid crystal panel is. If the resolution of the liquid crystal panel is determined, then the values of n, $V_{swing}$ and f are determined and can not be changed. Therefore, the purpose of reducing the power consumption of the liquid crystal panel can be achieved by decreasing the value of $C_{data}$.

Figure 1:
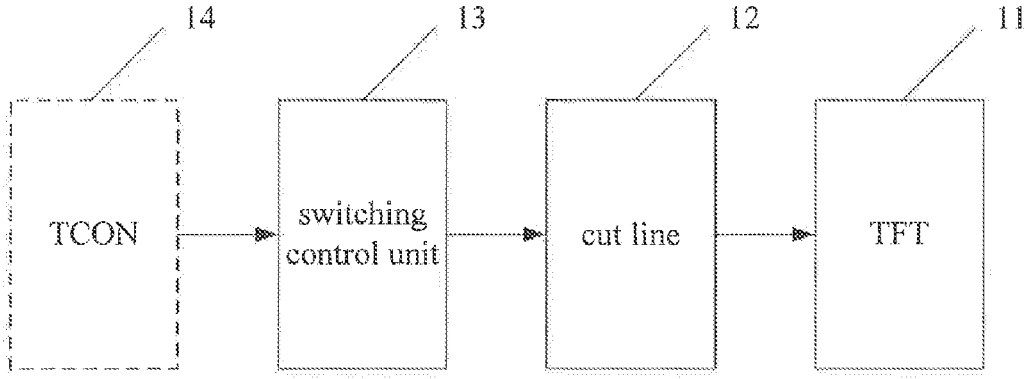
FIG. 1 is a schematic diagram showing a structure of an apparatus for reducing power consumption of a liquid crystal panel according to an embodiment of the present invention.

In view of this, an embodiment of the present invention provides an apparatus for reducing the power consumption of the liquid crystal panel as shown in FIG. 1, wherein the apparatus comprises: Thin Film Transistors 11 formed on each of data lines by a patterning process, a cut line 12 formed in the direction parallel to the gate lines and connected to the gate of the TFTs by a patterning process, and a switching control unit 13. The switching control unit 13 is used to control the on/off state of the TFTs 11 via the cut line 12 during transmission of a data signal so as to control the number of capacitors to be charged on the data line of the liquid crystal panel.

The number of the TFTs 11 on each of data lines can be more than one, and accordingly the number of the cut lines 12 can be more than one. In other words, the number of TFTs 11 on each of the data lines is equal to the number of the cut lines 12. For example, if the number of the TFT 11 on each of the data lines is equal to one, then the number of the cut lines 12 is equal to one; if the number of the TFTs 11 on each of the data lines is equal to two, then the number of the cut lines 12 is equal to two as well, and so on. Each of the cut lines 12 is connected to the gate of TFT 11 at the corresponding position on each of data lines so as to control the on/off state of the TFT 11.

In particular, the switching control unit 13 may be used to control via the cut lines 12 all the TFTs 11 to be turned on when the switching control unit 13 is informed that the data lines start to transmit a data signal, so that all the capacitors on the data lines are charged; and during the transmission of the data signal, control via the cut lines 12 located under the gate lines which complete the transmission of the data signal, the TFTs 11 connected to the cut lines 12 located under the gate lines which complete the transmission of the data signal to be turned off, so that the capacitors on the data lines which are located under the turned-off TFTs 11 are charged to continue the transmission of the data signal when being informed that the transmission of the data signal corresponding to the gate lines located above each of the cut lines 12 is completed.

The apparatus may further comprise a TCON 14, which informs the switching control unit 13 that the data line starts to transmit the data signal; and during the transmission of the data signal, informs the switching control unit 13 that the transmission of the data signal corresponding to the gate lines located above each of the cut lines 12 is completed.

The switching control unit 13 may further be used to control via the cut line 12 all the TFTs 11 to be turned on when informed by the TCON 14 that the data line starts to transmit the data signal; and control via the cut line 12 located under the gate lines which complete the transmission of the data signal the TFTs 11 connected to the cut lines 12 located under the gate lines which complete the transmission of the data signal, to be turned off when informed by the TCON 14 that the transmission of the data signal corresponding to the gate lines located above each of the cut lines 12 is completed.

The TCON 14 informs the switching control unit 13 that the data line starts to transmit the data signal via a timing control signal. Accordingly, during the transmission of the data signal, the TCON 14 informs the switching control unit 13 that the transmission of the data signal corresponding to the gate lines located above each of the cut lines 12 is completed.

The principles of the present disclosure will be described in detail below in combination with the embodiments.

Figure 2A:
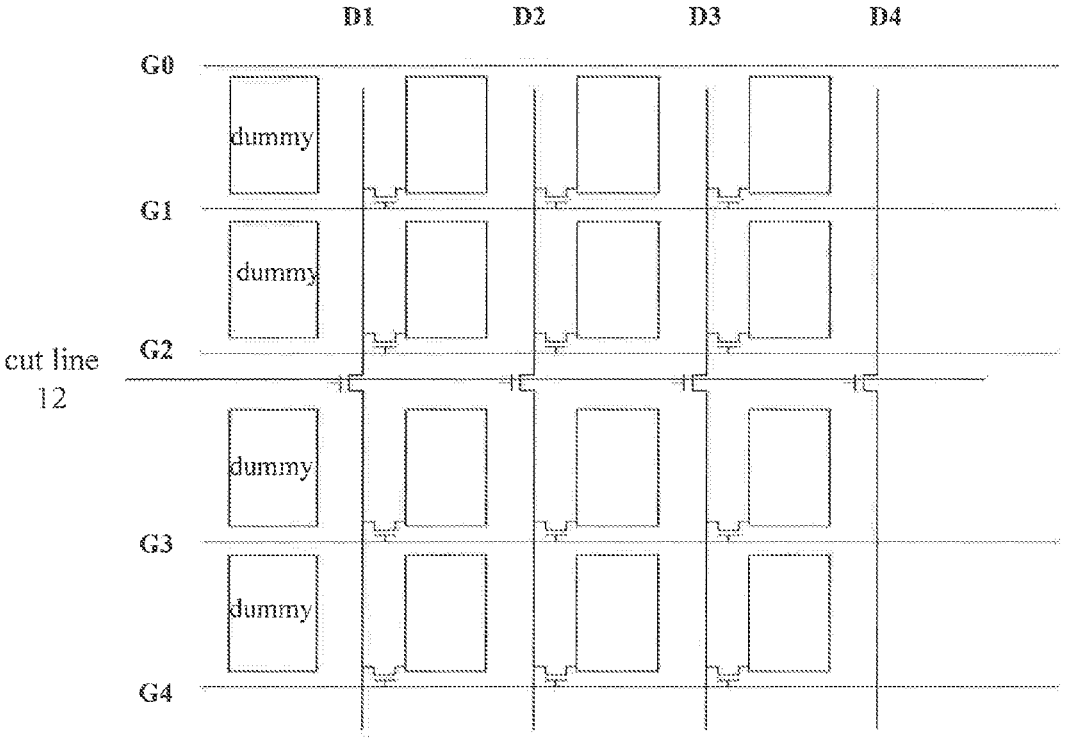
FIGS. 2A-2B are schematic diagrams showing Thin Film Transistors and cut line formed on a liquid crystal panel according to an embodiment of the present invention.
Figure 2B:
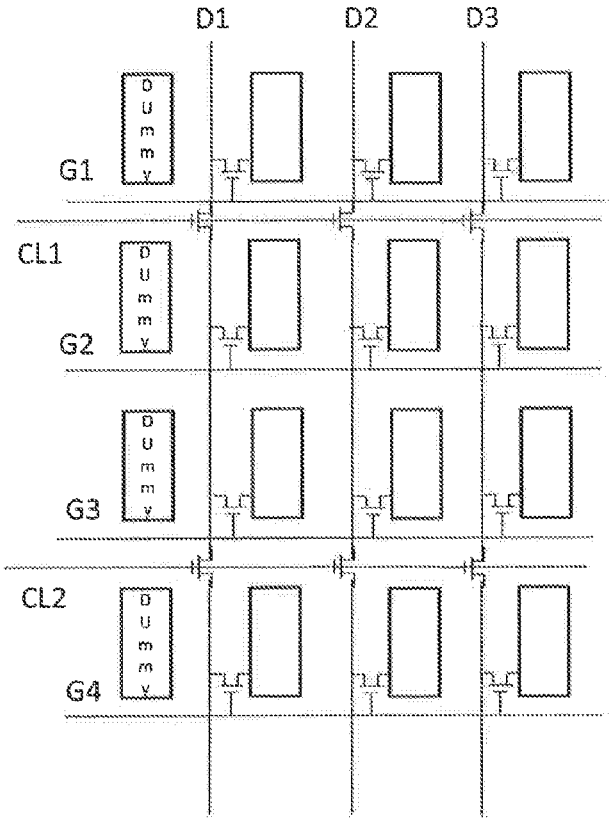

As shown in FIG. 2, in the embodiment, one TFT 11 is formed at the middle position of each of data lines on the liquid crystal panel by a patterning process, and a cut line 12 connected to the gate of the TFT 11 is formed in the direction parallel to the gate lines by the patterning process. At this time, all the pixel units on the liquid crystal panel are divided into two portions by the cut line 12, i.e., a upper portion and a lower portion. Accordingly, the capacitors on the data lines are divided by the cut line 12 into two portions, i.e., a upper portion and a lower portion, and all the gate lines of the liquid crystal panel are divided by the cut line 12 into two portions, i.e., a upper portion and a lower portion.

In the apparatus for reducing the power consumption of the liquid crystal panel provided in the embodiment of the present invention, when the data line starts to transmit the data signal, the TCON 14 informs the switching control unit 13 via the timing control signal that the data line starts to transmit the data signal; the switching control unit 13 outputs a high level signal to the gate of the TFT 11 via the cut line 12 after the switching control unit 13 is informed that the data line starts to transmit the data signal, so that the TFT 11 is turned on and the data signal can be transmitted normally. At the same time, all the capacitors on the data lines of the liquid crystal panel are charged by $V_{swing}$. At this time, the power consumption of the liquid crystal panel is as follows:

$$\text{Power}=\sim n*C_{data}*V_{swing}*f/2$$

When the number of the gate lines which are turned on is equal to the number of half of the gate lines on the entire liquid crystal panel, and when the TCON 14 informs the switching control unit 13 via the timing control signal that the transmission of the data signals above the cut line 12 is completed, that is, when G0~G2 shown in FIG. 2 are turned on, and the transmission of the data signals corresponding to G0~G2 is completed, the switching control unit 13 outputs a low level signal via the cut line 12 to the gate of the TFT 11 so as to turn off the TFT 11, so that only the capacitors in the lower portion are charged during the transmission of the data signals on the data lines, that is, only the respective capacitors on the gate line G3 and the subsequent gate lines are charged. At this time, the power consumption of the liquid crystal panel is as follows:

$$\text{Power}=\sim n*C_{data}/2*V_{swing}*f/2$$

Thus, compared to the situation that all the capacitors on the liquid crystal panel are charged, the power consumption of the liquid crystal panel can be reduced about a quarter by adopting the solution provided in the embodiment of the present invention.

At the same time, by adopting the solution provided in the embodiment of the present invention, the power consumption of a liquid crystal panel with a size of 10 inches and a resolution of 1280 RGB×800 is tested. In particular, when utilizing the solution in which all the capacitors on the liquid crystal panel are charged, it is found that the power consumption of gate lines is about 30 mW by detecting the values of R and C of the gate lines and the values of R and C of data lines on the liquid crystal panel, the averaged power consumption on each gate line is about 0.04 mW, and the power consumption of the data lines is 500 mW to the maximum extent.

In the solution of the embodiment of the present invention, one TFT is added at the middle position of each data line, and a cut line 12 is added in the direction parallel to the gate lines, and the on state of the TFT 11 is control by the switching control unit 13 such that the mode of the switching device of the capacitors on the data lines of the liquid crystal panel are controlled, and then the power consumption of the data lines is reduced a quarter. In other words, since the power consumption of the gate lines is very small and can be neglected, and the power consumption of the data lines can be reduced a quarter, the power consumption of the entire liquid crystal panel can be reduced 125 mW. Therefore, it proves that the solution provided in the embodiment of the present invention can effectively reduce the power consumption of the liquid crystal panel during the utilization of the liquid crystal panel.

Naturally, in an actual application, the number of TFTs 11 formed on each of the data lines may be two or more. Accordingly, the number of cut lines formed on the liquid crystal panel may be two or more and each of the cut lines is connected to the gate of the TFT 11 at the corresponding position on each of data lines, so that the on/off state of the TFT 11 can be controlled. When the number of TFTs 11 formed on each of the data lines is two and the number of cut lines 12 formed on the liquid crystal panel is two, all the pixel units on the liquid crystal panel will be divided into three portions of upper, middle and lower by the two cut lines 12. Accordingly, the capacitors on the data lines will also be divided into three portions of upper, middle and lower by the two cut lines 12, and all the gate lines on the liquid crystal panel will be divided into three portions of upper, middle and lower by the two cut lines 12 too.

In this case, when the data line starts to transmit the data signal, the switching control unit 13 outputs a high level signal via the two cut lines 12 to the gate of all the TFTs 11, so that all the TFTs 11 are turned on, and the data signal can be transmitted normally. At the same time, all the capacitors on the data lines of the liquid crystal panel are charged by $V_{swing}$. When the gate lines in the upper portion are turned on, it shows that the transmission of the data signals above the first cut line 12 is completed; that is, the transmission of the data signals corresponding to the gate lines in the upper portion is completed, the switching control unit 13 outputs a low level signal via the first cut line 12 to the gate of the TFTs 11 connected to the first cut line 12, so that the TFTs 11 connected to the first cut line 12 are turned off thereby during the transmission of the data signals on the data lines, only the capacitors in the middle and upper portions are charged, and the TFTs connected to the first cut line 12 are turned off. Further, when the gate lines in the upper and middle portions are turned on, it shows that the transmission of the data signals above the second cut line 12 is completed, that is, the transmission of the data signals corresponding to the gate lines in the upper and middle portions is completed; the switching control unit 13 outputs a low level signal to the TFTs 11 connected to the second cut line 12 via the second cut line 12, so that the TFTs 11 connected to the second cut line 12 are turned off as well thereby during the transmission of the data signals on the data lines, only the capacitors in the lower portion are charged. Thus, compared to the situation that all the capacitors on the liquid crystal panel are charged, the power consumption of the liquid crystal panel can be reduced about one third by adopting the solution of the embodiment of the present invention. By that analogy, the more the number of the TFTs 11 formed on each of the data lines is, correspondingly, the more the number of the cut lines 12 formed is, and thus the more the power consumption of the liquid crystal panel is reduced. Nevertheless, since the TFTs 11 and the cut lines 12 are formed by the patterning process, the more the number of the TFTs 11 formed on each of data lines is, correspondingly, the more the number of the cut lines 12 formed is, and accordingly the more complicated the patterning process is. Consequently, in a practical application, the complexity of the patterning process can be decreased as much as possible while the requirements of reducing the power consumption are met, that is, a tradeoff is made between the decrease of the complexity of the patterning process and the reduction of the power consumption.

Figure 3:
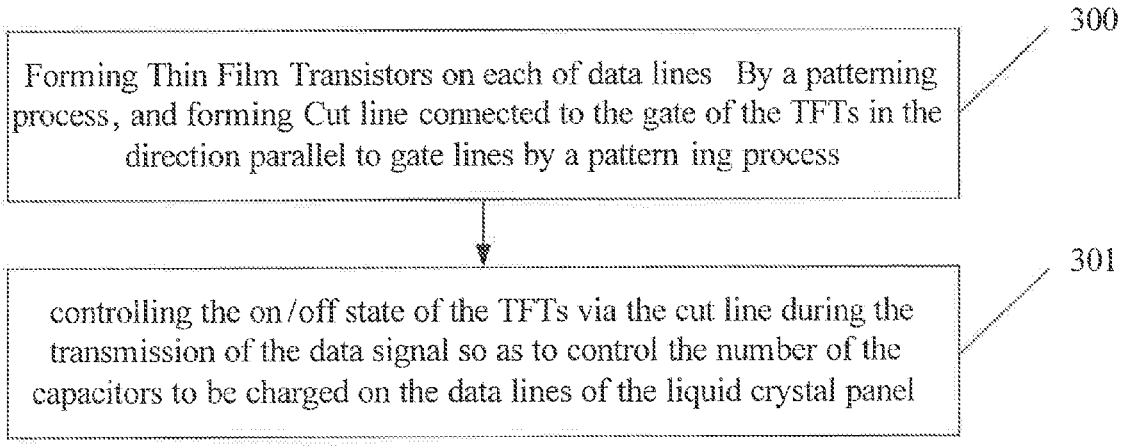
FIG. 3 is a schematic diagram showing a flow of a method for reducing the power consumption of the liquid crystal panel according to an embodiment of the present invention.

In accordance with another aspect of the invention, a method for reducing the power consumption of the liquid crystal panel is provided. As shown in FIG. 3, the method comprises:

step 300: forming TFTs on each of data lines by a patterning process, and forming cut lines connected to the gate of the TFTs in the direction parallel to the gate lines by a patterning process thereafter a step 301 is performed;

step 301: controlling the on/off state of the TFTs via the cut lines during the transmission of the data signal so as to control the number of the capacitors to be charged on the data lines of the liquid crystal panel.

Herein, the number of the TFTs on each of data lines can be more than one, and accordingly the number of the cut lines 12 can be more than one. In other words, the number of TFTs 11 on each of the data lines is equal to the number of the cut lines 12. For example, if the number of the TFTs 11 on each of the data lines is equal to one, then the number of the cut lines 12 is equal to one; if the number of the TFTs 11 on each of the data lines is equal to two, then the number of the cut lines 12 is equal to two as well, and so on. Each of the cut lines 12 is connected to the gate of TFT 11 at a respective position on each of data lines and thus controls the on/off state of the TFT 11.

In particular, the step 301 may be implemented as follows:

controlling all the TFTs to be turned on via the cut lines by a switching control unit when being informed that the data lines start to transmit the data signal, so that all the capacitors on the data line are charged; and during the transmission of the data signal, controlling the TFTs connected to the cut lines located under the gate lines which complete the transmission of the data signal to be turned off via the cut lines located under the gate lines which complete the transmission of the data signal by the switching control unit when being informed that the transmission of the data signal corresponding to the gate lines located above each of the cut lines is completed, so that the capacitors on the data lines which are located under the turned-off TFTs are charged to continue the transmission of the data signal.

Herein, being informed that the data lines start to transmit the data signal is embodied as follows:

the TCON informs the switching control unit that the data line starts to transmit the data signal.

Accordingly, being informed that the transmission of the data signal corresponding to the gate lines above each of the cut lines is completed is embodied as follows:

the TCON informs the switching control unit that the transmission of the data signal corresponding to the gate lines located above each of the cut lines is completed.

Further, the TCON informing the switching control unit that the data line starts to transmit the data signal is embodied as follows:

the TCON informs the switching control unit via a timing control signal that the data line starts to transmit the data signal.

Accordingly, the TCON informing the switching control unit that the transmission of the data signal corresponding to the gate lines located above each of the cut lines is completed is embodied as follows:

the TCON informs the switching control unit via a timing control signal that the transmission of the data signal corresponding to the gate lines above each of the cut lines is completed.

Further, the switching control unit controlling all the TFTs to be turned on is embodied as follows:

outputting a high level signal to the gate of all the TFTs via the cut line so that all the TFTs are turned on.

Accordingly, the switching control unit controlling via the cut line located under the gate lines which complete the transmission of the data signal the TFTs connected to the cut line located under the gate lines which complete the transmission of the data signal to be turned off is embodied as follows:

outputting a low level signal via the cut line 12 located under the gate lines which complete the transmission of the data signal, to the gate of the TFTs connected to the cut line located under the gate lines which complete the transmission of the data signal, so that the TFTs connected to the cut line located under the gate lines which complete the transmission of the data signal are turned off.

The above description only illustrates the exemplary embodiments of the present invention, and in no way limits the protection scope of the present invention which is defined by the appended claims.

What is claimed is:

1. An apparatus for reducing power consumption of a liquid crystal panel, comprising: Thin Film Transistors formed on each of data lines, a cut line formed in the direction parallel to gate lines and connected to the gate of the TFTs, and a switching control unit;

wherein, the apparatus further comprises a timer/counter controlling register for informing the switching control unit via a timing control signal that the data lines start to transmit the data signal and during the transmission of the data signal, and informing the switching control unit via the timing control signal that the transmission of the data signal corresponding to the gate lines located above each of the cut line is completed, the switching control unit is used to control the on/off state of the TFTs via the cut line during transmission of a data signal so as to control the number of capacitors to be charged on the data lines of the liquid crystal panel, the switching control unit is adapted to control all the TFTs to be turned on via the cut line when being informed by the timer/counter controlling register that the data lines start to transmit the data signal, so that all the capacitors on the data lines are charged; and during the transmission of the data signal, control the TFTs connected to the cut line located under the gate lines which complete the transmission of the data signal to be turned off, via the cut line located under the gate lines which complete the transmission of the data signal, when being informed by the timer/counter controlling register that the transmission of the data signal corresponding to the gate lines located above each of the cut line is completed, so that the capacitors on the data lines corresponding to gate lines located under each of the cut line are charged to continue the transmission of the data signal.

2. The apparatus of claim 1, wherein the number of the TFTs on each of data lines is more than one, and accordingly the number of the cut line is more than one.

3. The apparatus of claim 2, wherein the switching control unit is adapted to control all the TFTs to be turned on via the cut lines when being informed that the data lines start to transmit the data signal, so that all the capacitors on the data lines are charged; and during the transmission of the data signal, control the TFTs connected to the cut lines located under the gate lines which complete the transmission of the data signal to be turned off, via the cut lines located under the gate lines which complete the transmission of the data signal, when being informed that the transmission of the data signal corresponding to the gate lines located above each of the cut lines is completed, so that the capacitors on the data lines corresponding to gate lines located under each of the cut lines are charged to continue the transmission of the data signal.

4. A method for reducing power consumption of a liquid crystal panel; comprising:

forming Thin Film Transistors (TFTs) on each of data lines, and forming cut line connected to the gate of the TFTs in the direction parallel to gate lines; and controlling the on/off state of the TFTs via the cut line during the transmission of the data signal so as to control the number of the capacitors to be charged on the data lines of the liquid crystal panel by a switching control unit;

wherein the step of controlling the on/off state of the TFTs via the cut line during the transmission of the data signal so as to control the number of the capacitors to be charged on the data line of the liquid crystal panel by a switching control unit comprising:

controlling all the TFTs to be turned on via the cut line when being informed that the data lines start to transmit the data signal, so that all the capacitors on the data line are charged, and controlling the TFTs connected to the cut line located under the gate lines which complete the transmission of the data signal to be turned off, via the cut line located under the gate lines which complete the transmission of the data signal; by the switching control unit when being informed that the transmission of the data signal corresponding to the gate lines located above each of the cut line is completed, so that the capacitors on the data lines corresponding to gate lines located under each of the cut line are charged to continue the transmission of the data signal, during the transmission of the data signal;

the switching control unit is informed by a timer/counter controlling register that the data lines start to transmit the data signal and that the transmission of the data signal corresponding to the gate lines located above each of the cut line is completed.

5. The method of claim 4, wherein the number of the TFTs on each of data lines is more than one, and accordingly the number of the cut line is more than one.

6. The method of claim 5, wherein the step of controlling the on/off state of the TFTs via the cut line during the transmission of the data signal so as to control the number of the capacitors to be charged on the data line of the liquid crystal panel comprising:

controlling all the TFTs to be turned on via the cut lines by a switching control unit when being informed that the data lines start to transmit the data signal, so that all the capacitors on the data line are charged; and controlling the TFTs connected to the cut lines located under the gate lines which complete the transmission of the data signal to be turned off, via the cut lines located under the gate lines which complete the transmission of the data signal, by the switching control unit when being informed that the transmission of the data signal corresponding to the gate lines located above each of the cut lines is completed, so that the capacitors on the data lines corresponding to gate lines located under each of the cut lines are charged to continue the transmission of the data signal, during the transmission of the data signal.

7. The method of claim 4, wherein the timer/counter controlling register informs the switching control unit via a timing control signal that the data lines start to transmit the data signal and that the transmission of the data signal corresponding to the gate lines located above each of the cut line is completed.

8. The method of claim 4, wherein the step of controlling all the TFTs to be turned on is embodied by outputting a high level signal to the gate of all the TFTs via the cut line; and the step of controlling the TFTs connected to the cut line located under the gate lines which complete the transmission of the data signal to be turned off is embodied by outputting a low level signal to the gate of the TFTs connected to the cut line located under the gate lines which complete the transmission of the data signal via the cut line located under the gate lines which complete the transmission of the data signal.

* * * * *